US010538972B2

(12) United States Patent
Karlsson et al.

(10) Patent No.: US 10,538,972 B2
(45) Date of Patent: Jan. 21, 2020

(54) ARRANGEMENT FOR FEEDING AT LEAST A PART OF A DRILLING MACHINE, DRILLING SYSTEM AND METHOD FOR FEEDING AT LEAST A PART OF A DRILLING MACHINE

(71) Applicant: CONSTRUCTION TOOLS PC AB, Kalmar (SE)

(72) Inventors: Magnus Karlsson, Ljungbyholm (SE); Anders Lundgren, Degerhamn (SE); Robert Ivertsson, Kalmar (SE)

(73) Assignee: CONSTRUCTION TOOLS PC AB, Kalmar (SE)

( * ) Notice: Subject to any disclaimer, the term of this patent is extended or adjusted under 35 U.S.C. 154(b) by 840 days.

(21) Appl. No.: 15/028,603

(22) PCT Filed: Oct. 30, 2014

(86) PCT No.: PCT/SE2014/051279
§ 371 (c)(1),
(2) Date: Apr. 11, 2016

(87) PCT Pub. No.: WO2015/065278
PCT Pub. Date: May 7, 2015

(65) Prior Publication Data

US 2016/0265286 A1 Sep. 15, 2016

(30) Foreign Application Priority Data

Nov. 1, 2013 (SE) ..... 1351294

(51) Int. Cl.
*E21B 11/00* (2006.01)

(52) U.S. Cl.
CPC ..... *E21B 11/005* (2013.01)

(58) Field of Classification Search
CPC . E21B 7/021; E21B 7/025; E21B 1/00; E21B 21/10
(Continued)

(56) References Cited

U.S. PATENT DOCUMENTS 2,955,572 A 10/1960 Feucht et al.
3,085,638 A * 4/1963 Larcen ..... E21B 19/087 173/36
(Continued)

FOREIGN PATENT DOCUMENTS

DE 19803596 A1 8/1999
GB 812834 A 5/1959

OTHER PUBLICATIONS

PCT/ISA/210—International Search Report—dated Feb. 27, 2015 (Issued in Application No. PCT/SE2014/051279).
(Continued)

*Primary Examiner* — Chelsea E Stinson
(74) *Attorney, Agent, or Firm* — Venable LLP; Jeffri A. Kaminski

(57) ABSTRACT

An arrangement for feeding at least a part of a drilling machine in at least a first direction. A drilling system and a method are provided. The arrangement includes a first end portion, a second end portion, an outer cylinder, a piston and a piston rod. The piston and the piston rod are displaceably arranged in the outer cylinder such that the piston and the piston rod, the outer cylinder and the end portions delimits a first chamber and a second chamber for a pressure medium in the outer cylinder on a respective side of the piston. A valve is connected to the first chamber for reducing the pressure medium in the first chamber. The valve is arranged to be opened at an increased pressure in the second chamber.

12 Claims, 4 Drawing Sheets

(58) Field of Classification Search
USPC ..... 173/168, 169, 200
See application file for complete search history.

(56) References Cited

U.S. PATENT DOCUMENTS

| | | | | | |
|---|---|---|---|---|---|
| 3,132,703 | A * | 5/1964 | Larcen | E21B 19/087 | 173/158 |
| 3,191,692 | A * | 6/1965 | Ekwall | B25D 9/16 | 173/77 |
| 3,533,477 | A * | 10/1970 | Ekwall | E21B 19/087 | 173/36 |
| 4,010,819 | A * | 3/1977 | Ekstrom | B25D 17/12 | 181/230 |
| 4,024,923 | A | 5/1977 | Broadbent | | |
| 2012/0111590 | A1* | 5/2012 | Rothenwaender | A61C 1/003 | 173/15 |

OTHER PUBLICATIONS

PCT/ISA/237—Written Opinion of the International Searching Authority—dated Feb. 27, 2015 (Issued in Application No. PCT/SE2014/051279).

* cited by examiner

ARRANGEMENT FOR FEEDING AT LEAST A PART OF A DRILLING MACHINE, DRILLING SYSTEM AND METHOD FOR FEEDING AT LEAST A PART OF A DRILLING MACHINE

CROSS-REFERENCE TO RELATED APPLICATIONS

The application claims priority to Swedish patent application 1351294-2 filed 1 Nov. 2013 and is the national phase under 35 U.S.C. § 371 of PCT/SE2014/051279 filed 30 Oct. 2014.

TECHNICAL FIELD

The present invention relates to an arrangement for feeding at least a part of a drilling machine. The present invention further relates to a drilling system and a method for feeding at least a part of a drilling machine.

BACKGROUND

Arrangements for feeding a drilling machine or a part thereof are sometimes referred to as feeding-supports or supports, and are for example used when drilling with powerful rock-drilling machines. The arrangement is used to support the drilling machine, to provide feeding-power and/or to counteract reaction forces from the drilling machine.

A lower part of the arrangement is sometimes provided with one or more support legs which provide support against the ground for the arrangement while an upper part of the arrangement is attached to the drilling machine. Hereby the drilling machine with force may be fed in a drilling direction and an operator does not have to press the drilling machine forward. The arrangement often comprises a cylinder, a piston, a piston rod and controls for distributing a pressure medium in/out from the cylinder on any side of the piston. The piston with the piston rod is forced inwards or outwards from the cylinder in dependence of which side of the piston the pressure media is distributed to. A control for controlling the feeding may be arranged on the arrangement or on the drilling machine.

This type of arrangement may be driven pneumatically, i.e. with air or gas as pressure medium, or hydraulically, i.e. with water or oil as pressure medium. An arrangement with liquid as pressure medium often has a slower out- and in-movement of the piston rod as compared to an arrangement where air is used as pressure medium. A slow movement of the piston rod out of the cylinder is usually not a problem since a drilling rate speed of the drill/the drilling machine usually is not very high. On the other hand, a slow movement of the piston rod into the cylinder, i.e. when the arrangement is contracted before a new drilling cycle, means that a time amount needed for a drilling cycle is increased.

SUMMARY

An objective with the present invention is to provide an arrangement for feeding at least a part of a drilling machine in at least a first direction such that the time amount needed for a drilling cycle is reduced.

According to an embodiment of the present invention this is provided by an arrangement for feeding at least a part of a drilling machine in at least a first direction, the arrangement comprising a first end portion, a second end portion, an outer cylinder, a piston and a piston rod, where a first part of the arrangement is arranged to be attached to the drilling machine, a second part of the arrangement is arranged to be supported by the ground and the outer cylinder extends between the end portions, whereby the piston and the piston rod are displaceably arranged in the outer cylinder such that the piston along with the piston rod, the outer cylinder and the end portions delimit a first chamber and a second chamber for a pressure medium in the outer cylinder on a respective side of the piston, wherein the arrangement further comprises a valve connected to the first chamber for reducing the pressure medium in the first chamber and which valve is arranged to be opened at an increased pressure in the second chamber.

Since the arrangement comprises a valve connected to the first chamber for reducing the pressure medium in the first chamber at a pressure change in the second chamber, pressure medium can be drained from the first chamber faster than if the pressure medium have had to flow through conduits, control arrangements and similar in order to be drained. Faster reduction of the pressure medium in the first chamber allows the arrangement to be contracted faster, i.e. a length between the first end portion and a lower part of the piston rod can be decreased faster. Hereby the amount of time required for a drilling cycle is reduced.

A valve connected to the second chamber, i.e. directly connected such that pressure medium may be drained without having to pass any controls, any conduits, any pipe or other part is advantageous when considering a fall of pressure. With a directly-connected valve a desired flow is achieved and no large-diameter-conduits have to be used for the reduction of pressure medium in the first chamber. Hereby the arrangement may be compact and easy to use for a drill operator.

According to an embodiment the valve is arranged to be opened at an increased pressure in the second chamber.

A valve which opens at an increased pressure in the second chamber allows the arrangement to be contracted faster since both a reduction of the pressure in the first chamber and an increase of the pressure in the second chamber exert an influence on the piston to move towards the first end portion which reduces the length of the arrangement.

According to an embodiment, the valve is arranged to be closed at a decreased pressure in the second chamber and/or an increased pressure in the first chamber.

A valve arranged to be closed at a decreased pressure in the second chamber and/or an increased pressure in the first chamber allows replenishment of pressure medium in the first chamber, whereby the length of the arrangement increases. Hereby the arrangement can provide force and support when a new drilling cycle is started again.

According to an embodiment the second chamber is connected to a valve chamber, and a pressure in the valve chamber increases at an increased pressure in the second chamber.

With a valve chamber which is connected to the second chamber the valve can be controlled in dependence of the pressure in the second chamber in an easy and reliable manner.

According to an embodiment the valve comprises a valve seat, against which an, against the first chamber directed valve cone, is arranged to be opened/closed in dependence of the pressure in the valve chamber.

A valve with a valve cone which can open/close against a valve seat in dependence of the pressure in the valve chamber is a reliable and economically efficient way to control opening/closing of the valve based on the pressure in the second chamber.

According to an embodiment the valve is comprised in the piston.

A valve comprised in the piston is relatively protected from dirt and damage, and the arrangement may be designed relatively compact. Hereby the arrangement is both reliable and easy to use. Further, an older piston without valve may be exchanged to a new piston with a valve. Due to this, also performance of older arrangements for feeding a drilling machine may be increased.

According to an embodiment the valve is comprised in the first end portion.

A valve arranged in the first end portion is relatively protected from dirt and damage, and may easily be removed during cleaning or repair of the arrangement. Hereby the arrangement is both reliable and easy to serve and repair. Further an old first end portion without a valve may be exchanged to a new first end portion with a valve. Due to this, also performance of older arrangements for feeding a drilling machine may be increased.

According to an embodiment the valve is comprised in the outer cylinder.

A valve arranged in the outer cylinder may easily be removed during cleaning or repair of the arrangement. Hereby the arrangement is both reliable and easy to serve and repair. Further an old outer cylinder without a valve may be equipped with a valve which drains the pressure medium from the first chamber without any controls or conduits if the pressure is changed in the second chamber.

According to an embodiment the valve in its open position is arranged to drain the pressure medium in the first chamber out of the arrangement, preferably via a cavity in the piston rod.

A piston mounted valve arranged to drain the pressure medium out of the arrangement via the cavity in the piston rod facilitates the pressure reduction of the first chamber and pressure medium may be drained without bothering a drilling operator. The piston rod may be arranged as a cylinder which runs substantially concentrically inside the outer cylinder, where one end portion is fastened to the piston and the other end is open to atmospheric pressure. The cavity allows the pressure medium to flow out on the ground below an operator.

According to an embodiment the arrangement comprises one or more sensors arranged to detect a parameter representative of a change of pressure in the second chamber, and wherein the valve is arranged to be controlled in dependence of this detection.

An arrangement comprising one or more sensors arranged to detect a parameter representative of a change of pressure in the second chamber, and in which the valve is arranged to be controlled in dependence of this detection, allows the arrangement to be designed in different ways, for example based on where the arrangement is to be used. A parameter representative of a change of pressure in the second chamber is a parameter which changes when a pressure in the second chamber is changed, such as a change of distance between different parts of the arrangement.

According to an embodiment the valve is an elastic valve, a magnetic valve or an electrically controlled valve.

An elastic valve, a magnetic valve or an electrically controlled valve coupled to a sensor provides flexibility in how the arrangement may be designed. An elastic valve can be a valve made of elastic material, where a slit or similar in the elastic material may be opened/closed in dependence of a pressure change.

According to an embodiment the first end portion comprises a drilling machine coupling and/or the piston rod comprises at least one support leg.

An arrangement wherein the first end portion comprises a drilling machine coupling and/or the piston rod comprises at least one support leg is stable and may be used together with many existing drilling machines which are adopted to be fastened to a feeding arrangement with a drilling machine coupling.

An object with the present invention is also to provide a drilling system which reduces the time amount needed for a drilling cycle.

According to an embodiment, this is provided by a drilling system, wherein the drilling system comprises at least one arrangement according to embodiments described herein. A drilling system may comprise a drilling machine and an arrangement for feeding at least a part of a drilling machine.

An object with the present invention is also to provide a method which reduces the time amount needed for a drilling cycle.

According to an embodiment, this is provided by a method for draining pressure medium from an arrangement for feeding at least a part of a drilling machine in at least a first direction, the arrangement comprising a first end portion, a second end portion, an outer cylinder, a piston and a piston rod, where a first part of the arrangement is arranged to be attached to the drilling machine, a second part of the arrangement is arranged to be supported by the ground and the outer cylinder extends between the end portions, whereby the piston and the piston rod are displaceably arranged in the outer cylinder such that the piston along with the piston rod, the outer cylinder and the end portions delimits a first chamber and a second chamber for a pressure medium in the outer cylinder on a respective side of the piston, wherein the method comprises;

initiating a pressure change in the second chamber opening of a valve connected to the first chamber as a function of the pressure change, draining of pressure medium through the valve, whereby the pressure in the first chamber is reduced.

Since the method comprises initiating a pressure change pressure in the second chamber, opening of a valve connected to the first chamber as a function of the pressure change and draining of pressure medium through the valve, the pressure in the first chamber is rapidly reduced.

Further features of, and advantages with, the embodiments herein will become apparent when studying the appended claims and the following detailed description.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings, in which exemplifying embodiments are shown. However, this application should not be construed as limited to the embodiments set forth herein. Disclosed features of example embodiments may be combined as readily understood by one of ordinary skill in the art to which this application belongs. Like numbers refer to like elements throughout.

Well-known functions or constructions will not necessarily be described in detail for brevity and/or clarity.

Figure 1:
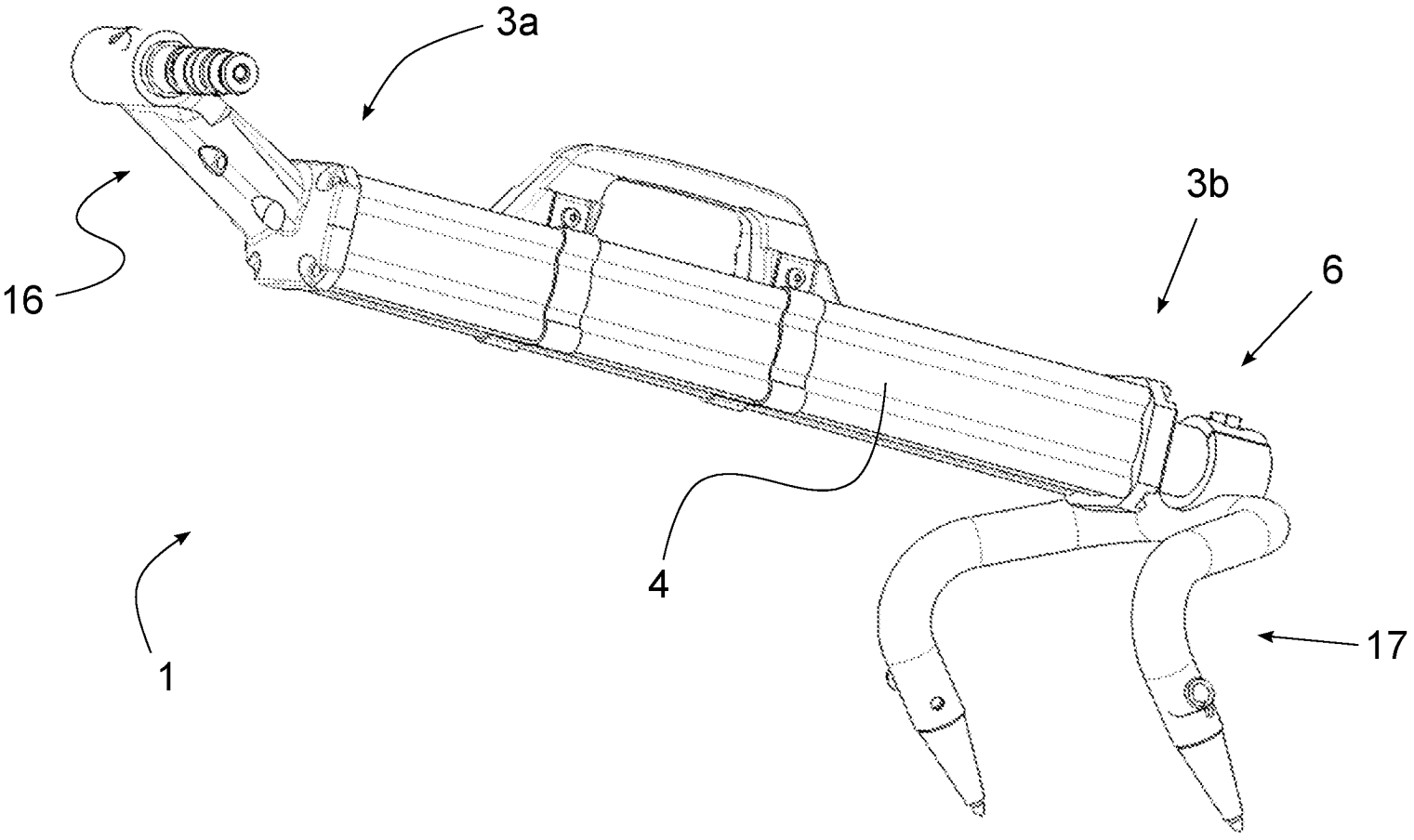
FIG. 1 illustrates an arrangement in perspective according so some embodiments.

FIG. 1 illustrates a perspective view of the arrangement 1 for feeding at least a part of a drilling machine (not shown) in at least a first direction. The first direction is preferably a drilling direction. The arrangement 1 is used for supporting the drilling machine, to provide force in the drilling direction and to counteract reaction forces from the drilling machine during drilling. The arrangement 1 comprises a first end portion 3*a*, a second end portion 3*b* and an outer cylinder 4. The arrangement 1 is arranged to be attached to the drilling machine directly or indirectly via a suitable coupling. The drilling machine may be attached to a coupling, to the first end portion 3*a* or to the cylinder 4. In FIG. 1 a coupling 16 for a drilling machine is illustrated. The drilling machine may be turned and/or rotated relatively the arrangement 1 via the coupling 16.

A first part of the arrangement 1 is configured to be attached to the drilling machine, and a second part of the arrangement is arranged to be supported by the ground. According to an embodiment, the first part comprises the first end portion 3*a* and/or the cylinder 4. The drilling machine may then be attached to the first end portion 3*a* and/or the cylinder 4. The second part comprises a piston rod 6 and/or one or several support legs. The piston rod 6 and/or the support legs are arranged to be supported by the ground. According to an embodiment, the arrangement 1 is arranged "upside down" compared to the embodiment illustrated in FIG. 1. According to such an embodiment, the first part comprises the piston rod 6 and/or one or several support legs. The drilling machine may then e.g. be attached to the piston rod 6. The second part comprises the first end portion 3*a* and/or the cylinder 4. The first end portion 3*a* and/or the cylinder 4 may then be supported by the ground.

According to some embodiments the arrangement 1 is arranged to be used for rock drilling, for example below the ground. The piston rod 6 is arranged to support against a foundation, such as soil, rock or any other foundation where the arrangement 1 is arranged. In order to better support the arrangement 1, the piston rod 6 may be provided with one or several supports or support legs 17. The support legs may provide support to at least a part of a drilling machine in at least a first direction while the drilling machine is fed forward during drilling. This facilitates for an operator who operates the drilling machine. By "feeding at least a part" of the drilling machine it is meant that at least a part of the drilling machine, preferably the drill, is displaced relatively to a reference point. A first direction may be forward, in the drilling direction, or rearwards in a direction oppositely the drilling direction. Accordingly, the arrangement 1 may be used both to feed a drilling machine and/or a drill forward during a drilling cycle and to feed the drilling machine and/or the drill rearwards, for example when an operator is stopping the drilling and is preparing to start a new drilling cycle.

The outer cylinder 4 extends between the end portions 3*a* and 3*b*. The embodiment illustrated in FIG. 1 has a cross section with an inner circular opening, while an outer part of the outer cylinder 4 comprises outer portions which increase the strength of the outer cylinder 4. Such outer portions may also form attachment portions for objects which are to be attached to the arrangement 1.

Figure 2:
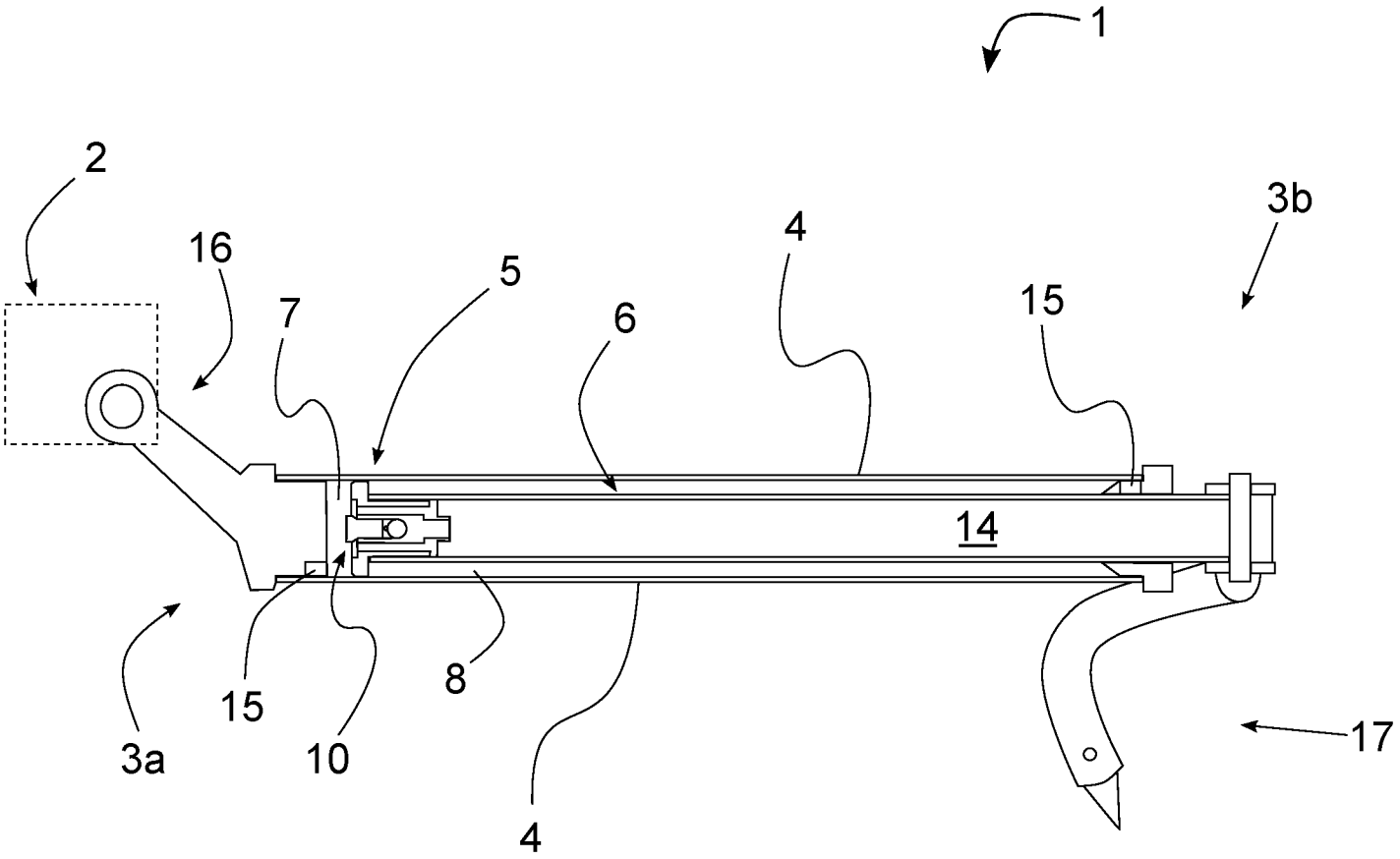
FIG. 2 illustrates a cross section of the arrangement according so some embodiments.

FIG. 2 illustrates the arrangement 1 according to some embodiments. As illustrated, the arrangement 1 may be coupled to an (schematically illustrated) drilling machine 2. The arrangement comprises end portions 3*a*, 3*b*, an outer cylinder 4 and a piston 5 connected to a piston rod 6. In FIG. 2 it is illustrated how the piston 5 and the piston rod 6 is displaceably arranged in the outer cylinder 4 such that the piston 5 and the piston rod 6, the outer cylinder 4 and the end portions together delimits a first chamber 7 and a second chamber 8 for a pressure medium in the outer cylinder 4 on a respective side of the piston 5. According to some embodiments the first chamber 7 is formed by the first end portion 3*a*, the outer cylinder 4 and the piston 5, while the second chamber 8 is formed by the piston 5, the second end portion 3*b*, the outer cylinder 4 and the piston rod 6. One or more gaskets may be arranged to prevent pressure medium to flow between the first 7 and the second 8 chamber 7 via a passage between the piston 5 and the outer cylinder 4. The gaskets may be arranged as one or more piston rings. The arrangement 1 may comprise or may be connected to supply means (not illustrated) for the pressure medium 9. The first chamber 7 may be arranged above a head of the piston 5 and the second chamber 8 may be arranged at a rear side of the piston 5.

The arrangement 1 further comprises a valve 10 which is connected to the first chamber 7. In the embodiment illustrated in FIG. 2 the valve 10 is arranged in the piston 5. In other embodiments the valve 10 may be arranged elsewhere, such as in the first end portion 3*a* or the outer cylinder 4. The valve 10 is arranged to be opened at a change of the pressure in the second chamber 8 in order to reduce the amount of pressure medium in the first chamber. According to some embodiments the valve 10 is arranged to be opened at a change of the pressure in the second chamber 8 in connection to feeding of the drilling machine 2. In connection to feeding may be during the feeding or e.g. when the operator pauses the feeding, for example when he/she is about to initiate a new drilling cycle. According to some embodiments the valve 10 is arranged to be opened at an increased pressure in the second chamber 8. The pressure medium may be a fluid, such as oil or water, or a gas, such as air.

The arrangement 1 may comprise one or more sensors 15. The one or more sensors 15 may be arranged to detect a parameter representative for a change of pressure in the second chamber 8. The valve 10 is then arranged to be controlled in dependence of the detection. In FIG. 2 two sensors 15 are illustrated in the end portions of the arrangement 1. In other embodiments the sensors 15 may be arranged in other parts of the arrangement 1. The position of the sensor 15 may depend on the type of sensor 15 and/or valve 10. The valve 10 may be e.g. a quick-draining valve, an elastic valve, a magnetic valve or an electrically controlled valve.

A parameter representative for a change of pressure in the second chamber 8 is a parameter which changes in dependence of a pressure change in the second chamber 8. Such a parameter may be a change of a length, a change of an electrical connection or resistance between different parts of the arrangement 1 or similar.

According to some embodiments the valve 10 is arranged to be closed at a decreased pressure in the second chamber 8 and/or an increased pressure in the first chamber 7.

In FIG. 2 a drilling machine 2 is schematically illustrated. The drilling machine 2 may be e.g. a rock drilling machine with a power in the range of 1-4 kilowatt. The drilling machine 2 may be a part of a drilling system, which drilling system also comprises an arrangement 1 for feeding the drilling machine 2. With a rock drilling machine is meant a drilling machine specially designed for rock drilling, for example during mining.

Figure 3:
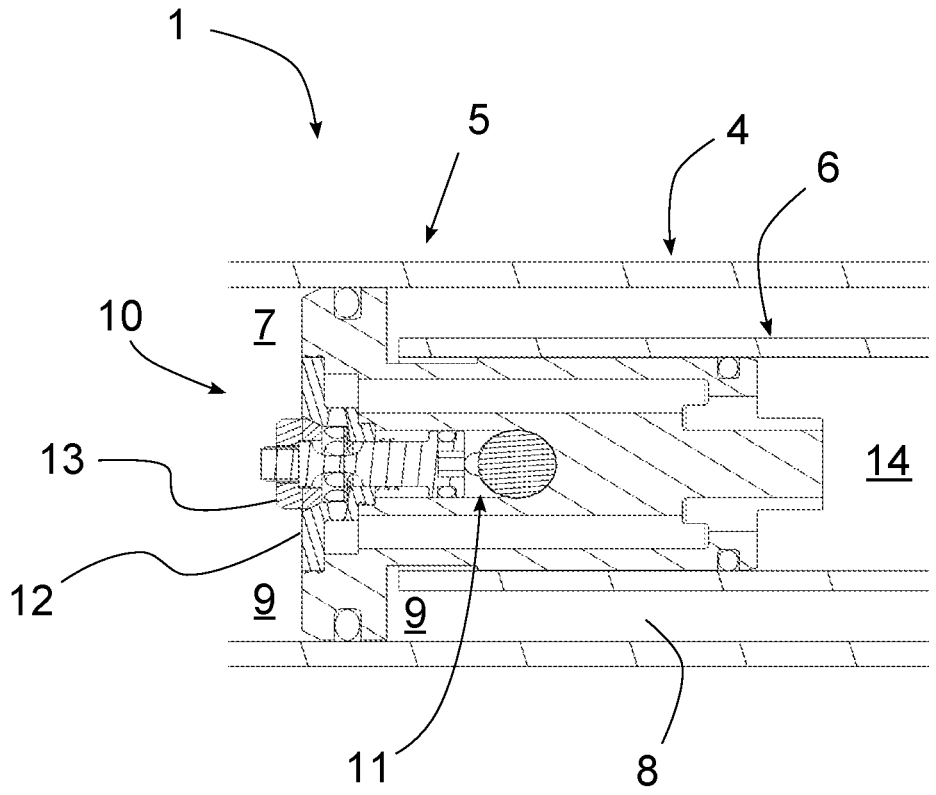
FIG. 3 illustrates a part of the arrangement according so some embodiments.
Figure 4:
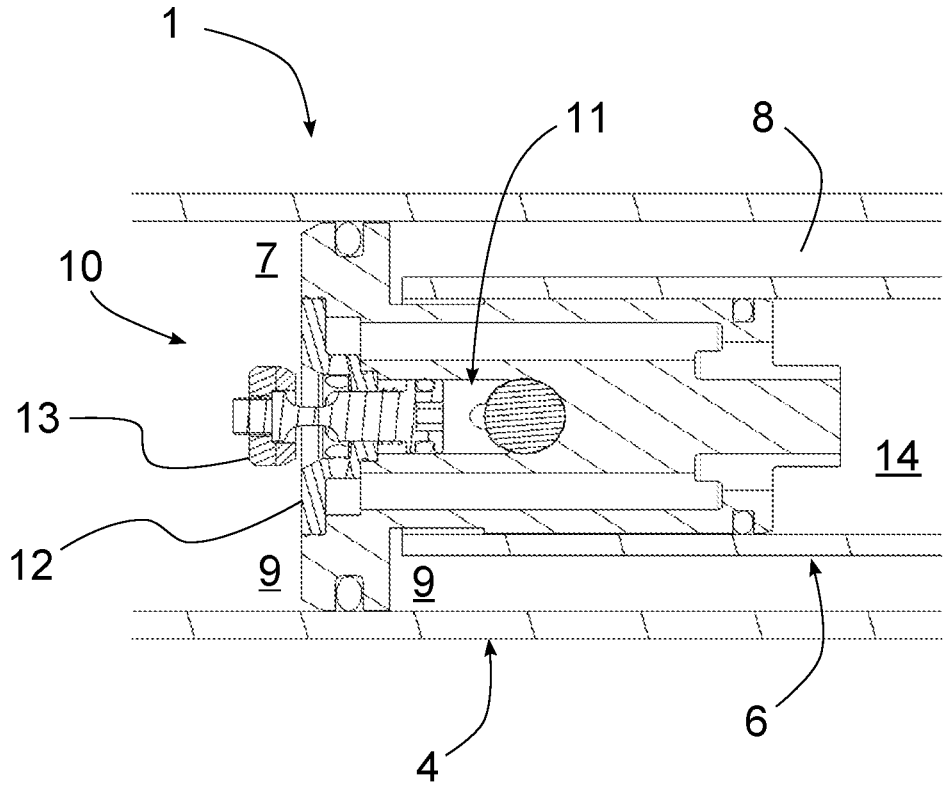
FIG. 4 illustrates a part of the arrangement according so some embodiments.

FIGS. 3 and 4 illustrates a cross section of the arrangement 1 and the valve 10.

FIG. 3 illustrates the valve 10 when closed. In this closed state the arrangement 1 is used as a conventional arrangement for feeding a drilling machine, i.e. the valve 10 constitutes a part of the piston 5 and delimits, together with the rest of the piston 5, the first 7 and the second chamber 8.

The second chamber 8 is in this embodiment connected to the valve chamber 11. A pressure medium 9 may flow between the second chamber 8 and the valve chamber 11 via an opening or passage, and when a pressure in the second chamber 8 is increased, the pressure in the valve chamber 11 is increased. The valve chamber 11 is comprised in or attached to the valve 10. The valve 10 further comprises a valve seat 12 against which an, against the first chamber 7 directed valve cone 13 is configured to be opened/closed in dependence of the pressure in the valve chamber 11. In order to press the valve cone 13 outwards, i.e. to the left in FIG. 3, a force acting on an inner part of the valve cone 13 from the pressure medium 9 is needed, which force needs to exceed a force from a positioning/resilient organ. According to the embodiment illustrated in FIG. 3 the valve cone 13 is positioned by a spring.

FIG. 4 resembles generally FIG. 3, but illustrates the valve 10 in an open position. In this open position the valve 10 is arranged to let a pressure medium 9 in the first chamber 7 be drained out from the arrangement 1 via a cavity 14 in the piston rod 6. When the valve 10 is open, the pressure medium 9 is allowed to be drained very fast from the first chamber 7 to the cavity 14 via the passage which is formed between the valve cone 13 and the valve seat 12. The cavity 14 may then convey the pressure medium 9 out from the arrangement 1 such that it is drained in the vicinity of the second end portion of the piston rod/the support legs. Since the cavity 14 is open in its lower end it is substantially an atmospheric pressure inside the cavity.

Figure 5:
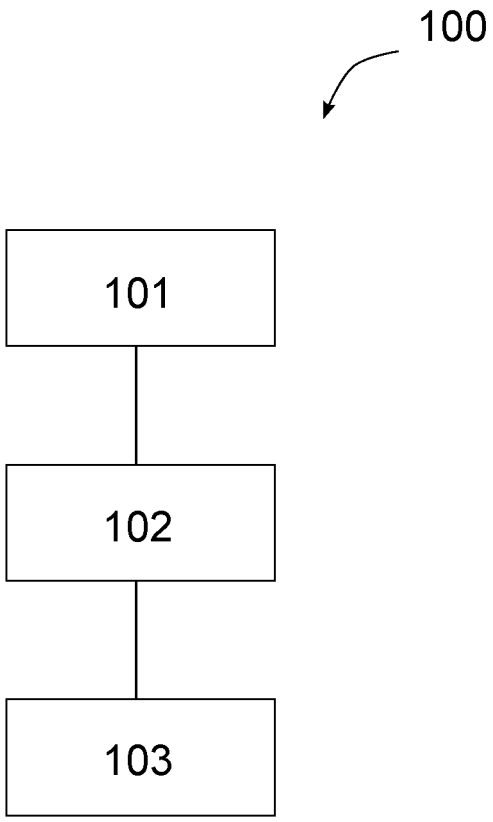
FIG. 5 illustrates a method.

FIG. 5 illustrates a method 100 for draining pressure medium from an arrangement for feeding at least a part of a drilling machine in at least a first direction, the arrangement comprising a first end portion, a second end portion, an outer cylinder, a piston and a piston rod, where a first part of the arrangement is arranged to be attached to the drilling machine, a second part of the arrangement is arranged to be supported by the ground and the outer cylinder extends between the end portions, whereby the piston and the piston rod are displaceably arranged in the outer cylinder such that the piston along with the piston rod, the outer cylinder and the end portions delimit a first chamber and a second chamber for a pressure medium in the outer cylinder on a respective side of the piston, wherein the method comprises:

initiating 101 a pressure change in the second chamber opening 102 of a valve connected to the first chamber as a function of the pressure change, draining 103 of pressure medium through the valve, whereby the pressure in the first chamber is reduced.

The invention claimed is:

1. An arrangement for feeding at least a part of a drilling machine in at least a first direction, the arrangement comprising:

a first end portion, a second end portion, an outer cylinder, a piston, a piston rod, wherein a first part of the arrangement is arranged to be attached to the drilling machine, a second part of the arrangement is arranged to be supported by the ground and the outer cylinder extends between the end portions, whereby the piston and the piston rod are displaceably arranged in the outer cylinder such that the piston along with the piston rod, the outer cylinder and the end portions delimits a first chamber and a second chamber for a pressure medium in the outer cylinder on a respective side of the piston, and a valve connected to the first chamber for reducing the pressure medium in the first chamber and which valve is arranged to be opened at an increased pressure in the second chamber, wherein the second chamber is connected to a valve chamber, such that a pressure in the valve chamber increases at an increased pressure in the second chamber.

2. The arrangement according to claim 1, wherein the valve further is arranged to be closed at at least one of a decreased pressure in the second chamber or an increased pressure in the first chamber.

3. The arrangement according to claim 1, wherein the valve further comprises a valve seat, against which an, against the first chamber directed valve cone, is arranged to abut, such that the valve is configured to be opened/closed in dependence of the pressure in the valve chamber.

4. The arrangement according to claim 3, wherein the valve in its open position is arranged to drain the pressure medium in the first chamber out of the arrangement.

5. The arrangement according to claim 1, wherein the valve is comprised in the piston.

6. The arrangement according to claim 1, wherein the valve is comprised in the first end portion.

7. The arrangement according to claim 1, wherein the valve is comprised in the outer cylinder.

8. The arrangement according to claim 1, further comprising:

at least one sensor arranged to detect a parameter representative of a change of pressure in the second chamber, wherein the valve is arranged to be controlled in dependence of this detection.

9. The arrangement according to claim 8, wherein the valve is a magnetic valve, an elastic valve or an electrically controlled valve.

10. The arrangement according to claim 1, wherein the first end portion comprises a drilling machine coupling and/or the piston rod comprises at least one support leg.

11. A drilling system, comprising:

at least one arrangement comprising a first end portion, a second end portion, an outer cylinder, a piston, a piston rod, wherein a first part of the arrangement is arranged to be attached to the drilling machine, a second part of the arrangement is arranged to be supported by the ground and the outer cylinder extends between the end portions, whereby the piston and the piston rod are displaceably arranged in the outer cylinder such that the piston along with the piston rod, the outer cylinder and the end portions delimits a first chamber and a second chamber for a pressure medium in the outer cylinder on a respective side of the piston, and a valve connected to the first chamber for reducing the pressure medium in the first chamber and which valve is arranged to be opened at an increased pressure in the second chamber.

12. A method for draining pressure medium from an arrangement for feeding at least a part of a drilling machine in at least a first direction, the arrangement comprising a first end portion, a second end portion, an outer cylinder, a piston and a piston rod, wherein a first part of the arrangement is arranged to be attached to the drilling machine, a second part of the arrangement is arranged to be supported by the ground and the outer cylinder extends between the end portions, whereby the piston and the piston rod are displaceably arranged in the outer cylinder such that the piston along with the piston rod, the outer cylinder and the end portions delimits a first chamber and a second chamber for a pressure medium in the outer cylinder on a respective side of the piston, the method comprising:

initiating a pressure increase in the second chamber, opening a valve connected to the first chamber as a function of the pressure increase, and draining of pressure medium through the valve, whereby the pressure in the first chamber is reduced.

* * * * *